US006544072B2

(12) United States Patent
Olson

(10) Patent No.: US 6,544,072 B2
(45) Date of Patent: Apr. 8, 2003

(54) ELECTRICAL CONNECTOR WITH METALLIZED POLYMERIC HOUSING

(75) Inventor: Stanley W. Olson, East Berlin, PA (US)

(73) Assignee: Berg Technologies, Reno, NV (US)

( * ) Notice: Subject to any disclaimer, the term of this patent is extended or adjusted under 35 U.S.C. 154(b) by 0 days.

(21) Appl. No.: 09/879,481

(22) Filed: Jun. 12, 2001

(65) Prior Publication Data

US 2002/0187679 A1 Dec. 12, 2002

(51) Int. Cl.[7] ..... H01R 13/648
(52) U.S. Cl. ..... 439/608; 439/607; 439/108
(58) Field of Search ..... 439/607, 608, 439/620, 74, 886, 609, 610, 108, 101

(56) References Cited

U.S. PATENT DOCUMENTS

| | | | | | |
|---|---|---|---|---|---|
| 4,603,936 | A | | 8/1986 | Jagen | 339/143 R |
| 4,613,191 | A | | 9/1986 | Papa | 339/14 R |
| 4,836,791 | A | * | 6/1989 | Grabbe et al. | 439/79 |
| 4,952,158 | A | | 8/1990 | Nakagawa | 439/96 |
| 5,175,928 | A | * | 1/1993 | Grabbe | 439/886 |
| 5,228,871 | A | | 7/1993 | Goodman | 439/607 |
| 5,373,101 | A | | 12/1994 | Barabolak | 174/35 R |
| 5,564,948 | A | * | 10/1996 | Harting et al. | 439/607 |
| 5,727,956 | A | * | 3/1998 | Mitra et al. | 439/74 |
| 6,083,047 | A | * | 7/2000 | Paagman | 439/608 |
| 6,116,926 | A | | 9/2000 | Ortega et al. | 439/108 |
| 6,293,827 | B1 | * | 9/2001 | Stokoe | 639/608 |

* cited by examiner

*Primary Examiner*—P. Austin Bradley
*Assistant Examiner*—Briggitte R. Hammond
(74) *Attorney, Agent, or Firm*—Harrington & Smith, LLP

(57) ABSTRACT

An electrical connector is provided. The electrical connector has a housing. Signal contacts are secured to the housing and ground contacts are secured to the housing. A portion of the housing is metallized to connect the ground contacts electrically and to shield the signal contacts.

22 Claims, 3 Drawing Sheets

ELECTRICAL CONNECTOR WITH METALLIZED POLYMERIC HOUSING

BACKGROUND OF THE INVENTION

This disclosure relates to backpanel connector systems, structures and methods for providing closer control of connector impedance and cross talk among high frequency communication signals carried over densely packed signal lines.

More specifically, the present disclosure relates to the use of grounded conductive paths to shield adjacent signals, or differential signal pairs, from one another at the backplane of, for example, a switch, a router, access server and other network communication system devices involved with transferring voice, video and other forms of data at a gigabit per second (Gb/s) and higher data rates between user and provider sites.

The increasingly stringent requirements for higher system bandwidth necessitate closer control of connector impedance and suppression of crosstalk to preserve the integrity of network information. These requirements have been met earlier with strategically positioned stamped and formed metal ground shields that separate single signal communication lines, or differential signal line pairs, from other signal lines/line pairs and provide a return path to ground. An example of such ground shields is in U.S. Pat. No. 6,116,926. However, these spaced ground shields can be cumbersome, expensive and, more importantly, may not provide adequate shielding and grounding for future systems having substantially higher line densities and carrying signals at substantially higher data rates. An example of an earlier developed backpanel connector using the aforementioned metal ground shielding includes the METRAL® 3000 Series 2 mm backpanel connector systems available from FCI USA, Inc. Information about a METPAL® 3000 connector is available from FCI USA, Inc. in a brochure identified by part number 950534-008 and dated Aug. 8, 2000. Another earlier development of connectors using metallized plastic connector housings includes a shielded connector disclosed in U.S. Pat. No. 5,228,871.

The shortcomings of earlier developed connectors employing multiple, metal conductive shields to electrically isolate single data signal lines or differential pair data signal lines from other single lines or differential pairs of lines are overcome with the new and improved connector disclosed herein.

SUMMARY OF THE INVENTION

In accordance with one embodiment of the present invention, an electrical connector is provided. The electrical connector has a housing. Signal contacts and ground contacts are secured to the housing. A portion of the housing is metallized to connect the ground contacts electrically and to shield the signal contacts.

In accordance with another embodiment of the present invention, a backplane receptacle connector is provided. The backplane receptacle connector has an exterior housing. A plurality of sub-assemblies are arranged within the exterior housing. Each sub-assembly has a housing. Signal contacts and ground contacts are secured to the housing. A portion of each of the housings are metallized to connect the ground contacts electrically and to shield the signal contacts.

In accordance with a method of the present invention, a method of shielding a connector is provided having a first step of providing a housing with contacts secured thereto. Another step of metallizing a portion of the housing to connect the contacts electrically is then provided.

BRIEF DESCRIPTION OF THE DRAWINGS

The foregoing aspects and other features of the present invention are further disclosed in the following description considered alone and in conjunction with the accompanying drawings, wherein.

DESCRIPTION OF THE EMBODIMENTS

Figure 1:
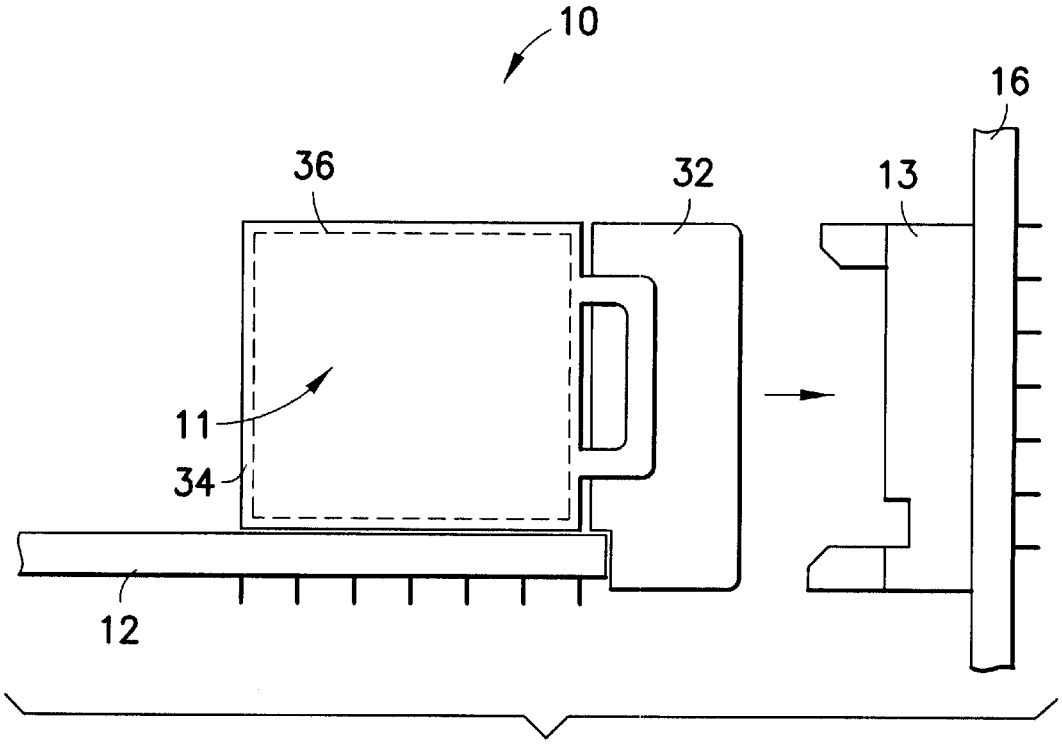
FIG. 1 is a schematic diagram of a connector system incorporating features of the present invention.

The system 10 of FIG. 1 represents a combination of four components that make up a portion of a digital signal communication network within which the present invention is employed. Although the present invention will be described with reference to the embodiments shown in the drawings, it should be understood that the present invention can be embodied in many alternate forms or embodiments. In addition, any suitable size, shape or type of elements or materials could be used. The components of system 10 include receptacle connector 11. Connector 11 is built from sub-assemblies which provide multiple, low-impedance, electrically shielded signal paths for gigabit per second (Gb/s) and higher network data signal transmission. The receptacle 11 mounts to a daughter card 12, for example a network telephone subscriber line card. The receptacle 11 mates with a header connector 13 secured to a compatible backpanel 16, such as a network data switch.

Receptacle 11 includes a forward external housing 32 and a rear external housing 34. The housings secure together to retain a plurality of subassemblies 36 (shown in phantom for clarity) therebetween. Each sub-assembly includes signal and ground contacts to engage corresponding pins on the header 13. The sub-assembly will be described in more detail below.

Figure 2A:
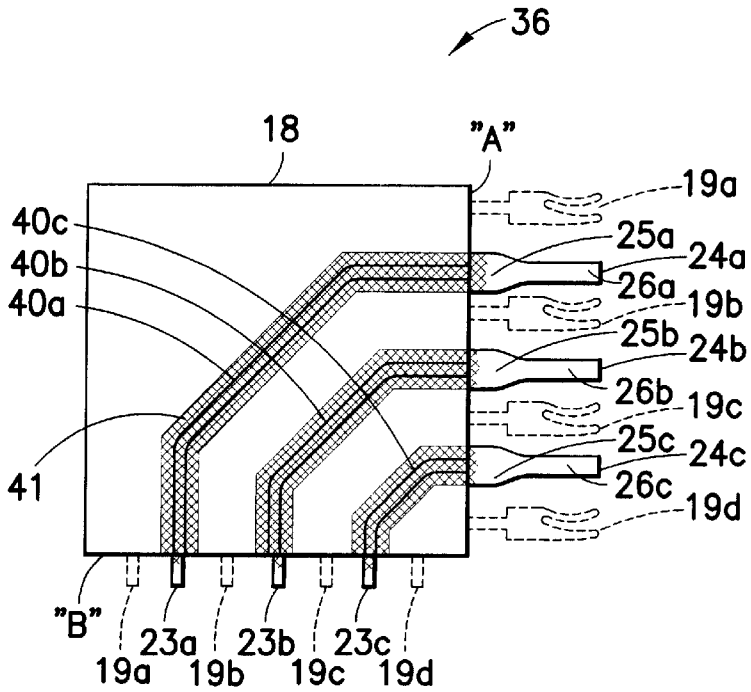
FIG. 2*a* is an external view of a sub-assembly housing of the connector in FIG. 1.
Figure 2B:
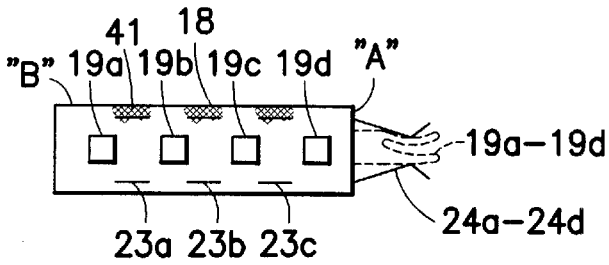
FIG. 2*b* is a top plan view of a sub-assembly housing.
Figure 2C:
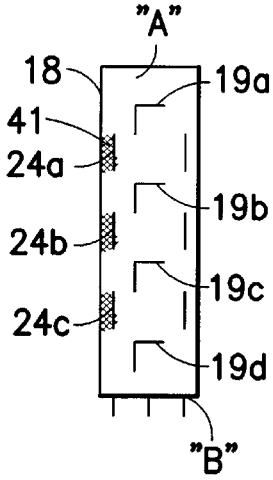
FIG. 2*c* is a front side elevation view of a sub-assembly housing.

FIGS. 2*a*, 2*b* and 2*c* disclose one embodiment of receptacle connector sub-assembly with one column of signal contacts.

The sub-assembly 36 of FIG. 2*a* has an insulative housing 18 through which data signal contacts 19*a*, 19*b*, 19*c* and 19*d* extend (signal contacts are shown in phantom for clarity). The signal contacts have a female mating section at housing face "A" to engage a header pin and a male mounting section at housing face "B" to secure receptacle 11 to board 12. Preferably, housing 18 is overmolded about contacts 19*a*–19*d*.

The exterior of housing 18 includes a series of grooves 40*a*–40*c* in the sidewalls (see FIG. 2*a*). The grooves 40*a*–40*c* can be formed when the housing is overmolded about the signal contacts 19*a*–19*d*. Specifically, the grooves are located between two adjacent signal contacts. As will become evident below, the grooves are beneficial during metallization of housing 18.

The sub-assembly 36 also includes grounding features. Specifically, the sub-assembly includes mating contacts 24*a*–24*c* and mounting contacts 23*a*–23*c*. These ground contacts are preferably inserted into the housing 18 in a process known as staking. However, the housing 18 could be overmolded about these ground contacts along with mating contacts 24*a*–24*c*. These contacts extend from the end faces "A", "B" of housing 18 adjacent the bottom of the grooves 40*a*–40*c*. To make the electrical connection between mating contacts 24*a*–24*c* and mounting contacts 23*a*–*c*, selected portions of the housing are then metallized. Preferably, the entire exterior of housing 18, save the locations from which signal contacts 19*a*–19*dc* extend, are metallized with conductive metallization 41. The exterior surfaces are metallized using any suitable process such as, for example, electroless plating, electrolytic plating, sputtering and vacuum metallization.

FIG. 2*b* depicts dual beam signal contacts 19*a*–19*d*. The beams are mechanically biased to apply a contact force to the header signal pins. The dual beam contact helps maintain an electrical connection between two connectors after multiple insertions and withdrawals over time and over multiple temperature cycles.

The receptacle ground contacts 24*a*–24*c* mate with male pins from header 13 of FIG. 1, for example. The contacts 24*a*–24*c* each include a single beam to engage the header pin. The resiliently flexible ground contacts 24*a*–24*c* are tapered to provide a normal force adequate to maintain contact with the header pins over repeated cycles of insertion and withdrawal over time and over wide temperature cycles and to protect the metallization layers.

FIG. 2*c* is a front view of side "A" of the sub-assembly that includes a row of four female receptacle contacts 19*a*, 19*b*, 19*c* and 19*d* and three ground contacts 24*a*, 24*b* and 24*c*. Each grounding contact 24*a*–24*c* within a single column is located between two corresponding receptacle contacts 19*a*–19*b*, 19*b*–19*c*, 19*c*–19*d*.

Although FIGS. 2*a*–2*c* show a pin-in-paste (PIP) type termination to board 12, other terminations, for example, press-fit, surface mount or otherwise could be used.

Figure 3A:
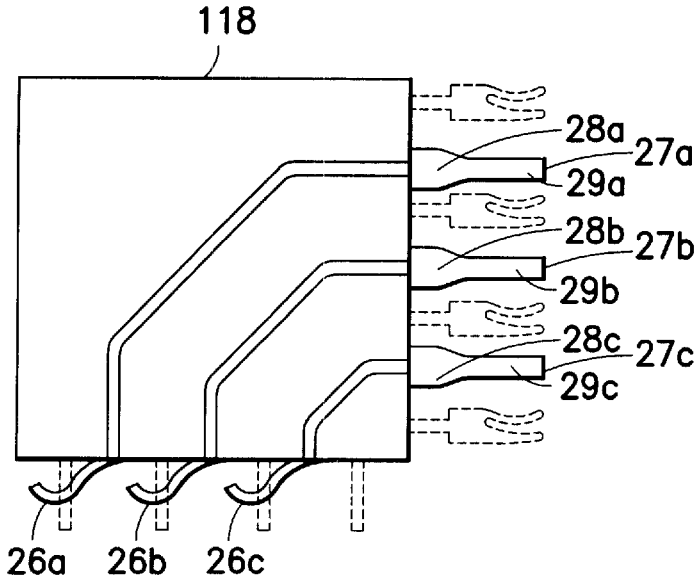
FIG. 3*a* is an external view of a second embodiment sub-assembly housing.
Figure 3B:
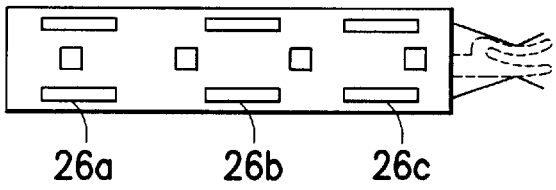
FIG. 3*b* is a top plan view of the second embodiment sub-assembly housing.

Referring now to FIGS. 3*a*–3*b*, there is shown a second embodiment of the present invention. The structure of housing 118 is substantially the same as housing 18 shown in FIGS. 2*a*–2*c*. One difference is that spring connectors 26*a*–26*c* are used as ground terminals rather than pin terminals. (See, FIGS. 3*a* and 3*b*.).

Figure 4:
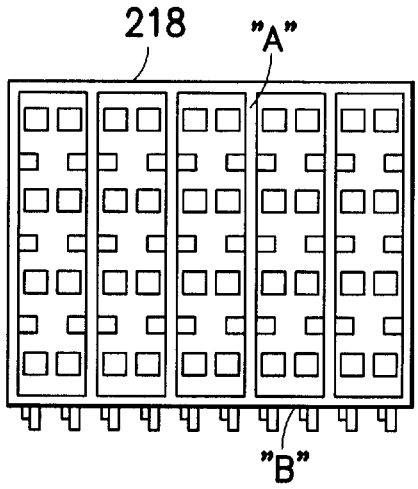
FIG. 4 is a front elevation view of the second embodiment sub-assembly housing.

FIG. 4 is a front, elevational view of a third alternative embodiment of the sub-assembly. The general structure of housing 218 is substantially the same as the housings for the first and second embodiments described previously. Rather than the single-ended arrangement of the first and second embodiments, however, housing 218 is wider to accommodate two columns of signal contacts in a differential pair arrangement.

As stated above, selected exterior surfaces of the housing are metallized. Various processes including electroless, electrolytic plating, sputtering and vacuum metallization, for example, could be used.

In order to metallize only certain portions of the housing, a mask (not shown) may be used to protect the remaining portions of the housing, along with the signal contacts 19*a*–19*d*. The mask should hide only a portion of the ground contacts 23*a*–23*c*, 24*a*–24*c*. In other words, a section of each ground contact 23*a*–23*c*, 24*a*–24*c* is exposed to metallization. Thus, the coating formed by metallization electrically connects ground contacts 23*a* to 24*a*, 23*b* to 24*b* and 23*c* to 24*c*.

The metallization also enters the grooves on the housing. Metallization of the grooves serves to introduce a ground shield between two adjacent signal contacts in a column. The remainder of the metallization serves as a ground shield between adjacent columns of signal contacts. Such shielding helps reduce cross-talk between the signal lines.

Rather than directly engage the metallized layer, the ground contacts on the header mate with the resilient ground contacts on the receptacle. Since the receptacle ground contacts are also partially metallized, the shape of the contact is controlled to prevent damage to the metallized layer. As can be seen in FIGS. 2*a*, 3*a* the preferred shape of the receptacle ground contacts 24*a*–24*c* and 27*a*–27*c* is a wide proximal base 25*a*–25*c* and 28*a*–28*c* adjacent the housing 18, 118 and a narrower distal end 26*a*–26*c* and 29*a*–29*c* away from the housing to engage the header pin or the PCB. Preferably, metallization occurs at the wider proximal end of the ground contacts.

The narrower distal end deflects upon engaging the header pin or the PCB. Such deflection, however, is not observed in the wider proximal end. Without deflection, the metallized layer located on the wider proximal end is unaffected by the mating cycles.

When the sub-assemblies are mounted side to side within the outer housings, the arrangement creates a mechanically and electrically stable structure able to electrically shield large numbers of data signal lines or differential pairs operating at Gb/s data rates and higher.

The electrical shielding of a single data signal line or data signal differential line pair is achieved by:

(1) electrically coupling each ground 23*a*–23*c*, 24*a*–24*c* to a metallized layer shown on housing 18 at 41 or coating on the housing, and (2) coupling the ground contacts 23*a*, 23*b* and 23*c* and 24*a*, 24*b* and 24*c*, respectively, to the ground plane of a subscriber line card 12, for example, and to the ground plane of a back panel 16, through header 13 for example; and The minimization or elimination of movement at the interface of a connector 11 to a printed wiring board (PWB) such as the PWB of the line card 12 ensures that continuity will be maintained through a number of deflections cycles. The spring members 23*a*–23*c* or 26*a*–26*c* at the base of the sub-assembly bring continuity to the ground plane on PWB 12 to which a connector 11 is mounted. The same minimization of movement is achieved by the wider proximal end of contacts 24*a*–24*c* or 27*a*–27*c*.

When a multiple-column embodiment of connector 11 is mounted to a PWB, the metalized housing and pins are terminated to the PWB via a number of conventional surface mount (SMT) soldering processes including infrared (IR), convection heating, wave soldering, intrusive reflow and Ball Grid Array (BGA)

A combination of the above processes can be used whereby a soldered interface is introduced to terminate the metalized housing to the PWB with a spring member used to carry the shielding to the mating connector.

Although the previously described embodiments refer to the metallization of the ground lines, it is understood that the signal lines could also be metallized in the same fashion. As an example, one side wall of a housing could be metallized to connect electrically the signal contacts, while the other side of the housing could be metallized to connect the ground contacts. To ensure separation of the ground and signal lines, a spacer could be placed between adjacent sub-assemblies when inserted into the exterior housings.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector, comprising:

a housing having grooves on an exterior surface;

signal contacts secured to said housing;

ground contacts secured to said housing;

wherein a portion of said housing including the grooves is metallized to connect said ground contacts electrically and to shield said signal contacts, wherein said housing is not completely metallized, and wherein said metallized grooves extend between said signal contacts in a column.

2. The connector as recited in claim 1, wherein said housing is overmolded to said ground contacts.

3. The connector as recited in claim 1, wherein said ground contacts are inserted into said housing.

4. The connector as recited in claim 1, wherein said ground contacts extend from said housing adjacent said grooves.

5. The connector as recited in claim 1, wherein the grooves are located between two adjacent signal contacts.

6. The connector as recited in claim 1, wherein the grooves shield two adjacent signal contacts.

7. The connector as recited in claim 1, wherein the grooves separate two adjacent signal contacts.

8. The connector as recited in claim 1, wherein a portion of each of said ground contact is also metallized.

9. The connector as recited in claim 8, wherein said ground contacts each have a proximal end adjacent said housing and a distal end extending from said housing, and said proximal end of at least one of said ground contacts is wider than said distal end.

10. The connector as recited in claim 9, wherein said proximal end of said each ground contact is metallized.

11. A backplane receptacle connector, comprising:

an exterior housing; and a plurality of sub-assemblies arranged within said exterior housing, each sub-assembly having:

a housing having grooves on an exterior surface;

signal contacts; secured to said housing; and ground contacts secured to said housing;

wherein a portion of said housings including the grooves are metallized to connect said ground contacts electrically and to shield said signal contacts.

12. The receptacle connector as recited in claim 11, wherein said signal contacts in said sub-assemblies are arranged in a single column.

13. The receptacle connector as recited in claim 11, wherein said signal contacts in said sub-assemblies are arranged in two adjacent columns.

14. The connector as recited in claim 11, wherein said ground contacts extend from said housing adjacent said grooves.

15. The connector as recited in claim 11, wherein the grooves are located between two adjacent signal contacts.

16. The connector as recited in claim 11, wherein the grooves shield two adjacent signal contacts.

17. The connector as recited in claim 11, wherein the grooves separate two adjacent signal contacts.

18. The receptacle connector as recited in claim 11, wherein a portion of each of said ground contact is metallized.

19. The receptacle connector as recited in claim 18, wherein said ground contacts each have a proximal end adjacent said housing and a distal end extending from said housing, and said proximal end of at least one of said ground contacts is wider than said distal end.

20. The receptacle connector as recited in claim 19, wherein said proximal end of said each ground contact is metallized.

21. A method of shielding a connector, comprising the steps of:

providing a housing with signal contacts and ground contacts secured thereto and grooves on an exterior surface; and metallizing a portion of said exterior of said housing including the grooves to effect a connection of said ground contacts electrically, wherein said portion of said exterior of said housing comprises less than an entire exterior surface of said housing, and wherein said metallized grooves extend between said signal contacts in a column.

22. The method as recited in claim 21, wherein said metallizing step comprises one of electrolytic plating, electroless plating, sputtering or vacuum metallization.

* * * * *